US007118415B2

(12) United States Patent
Konda

(10) Patent No.: US 7,118,415 B2
(45) Date of Patent: Oct. 10, 2006

(54) CONDUCTIVE PATH

(75) Inventor: Kazumoto Konda, Mie (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/882,225

(22) Filed: Jul. 2, 2004

(65) Prior Publication Data

US 2005/0037665 A1 Feb. 17, 2005

(30) Foreign Application Priority Data

Jul. 3, 2003 (JP) ..... P2003-191120

(51) Int. Cl.
*H01R 9/05* (2006.01)

(52) U.S. Cl. ..... 439/578; 439/926; 439/939

(58) Field of Classification Search ..... 710/105–106, 710/8; 709/200; 701/1; 370/401; 341/173; 439/578, 585, 939, 564, 926, 95
See application file for complete search history.

(56) References Cited

U.S. PATENT DOCUMENTS 4,824,400 A * 4/1989 Spinner ..... 439/578
5,100,344 A * 3/1992 Truong ..... 439/578
5,134,645 A * 7/1992 Berken et al. ..... 455/465
5,790,065 A * 8/1998 Yaroch ..... 341/173
6,129,563 A * 10/2000 Weidner ..... 439/92
6,246,688 B1 * 6/2001 Angwin et al. ..... 370/401
6,711,474 B1 * 3/2004 Treyz et al. ..... 701/1
6,810,435 B1 * 10/2004 Palmer et al. ..... 710/8

FOREIGN PATENT DOCUMENTS

JP 08-250219 9/1996

* cited by examiner

*Primary Examiner*—Javaid H. Nasri
(74) *Attorney, Agent, or Firm*—Oliff & Berridge, PLC

(57) ABSTRACT

In a conductive path, a terminal portion is integrally formed at an end of the metallic conductor to be connected to the mating terminal. A metallic pipe accommodates the metallic conductor. A tubular-shaped insulating tube is provided between the metallic conductor and the metallic pipe. A bracket conductively connects the metallic pipe to the shielding shell of the apparatus side. The number of parts of the conductive path of the invention is less than that of the conductive path which has a terminal portion separately formed from the metallic conductor and connecting to a terminal portion of the apparatus side.

12 Claims, 6 Drawing Sheets

CONDUCTIVE PATH

BACKGROUND OF THE INVENTION

1. Field of the Invention

The present invention relates to a conductive path having a shielding function.

2. Description of the Related Art

A conductive path having a shielding function thus far developed is provided with a shielded wire including a conductor enclosed in an insulative core, a shielding layer made of a braided wire disposed around an outer circumferential surface of the core, and an insulative sheath enclosing the shielding layer; a terminal fitting connected to the conductor in the shielded wire; and a shielding shell to which the shielding layer of the shielded wire is connected, and the terminal fitting and the shielding shell are attached to a housing (Ref. patent Document 1). When the housing of such a conductive path is fitted with a housing of a mating apparatus, the terminal fitting is connected to a terminal of the mating apparatus, and also the shielding shell is connected to that of the mating apparatus.

When the conductive path constituted of such a shielded wire is used where interference by a foreign object may take place (for example when connected to an electric vehicle), the shielded wire is enclosed in a bellows-type corrugated tube, and the corrugated tube enclosing the shielded wire is further enclosed in a highly rigid protector, for the purpose of protection. (Please see JP-A-8-250219)

A conductive path including a conventional shielded wire constituted as above has a drawback in that the number of parts is too many, since a terminal fitting, which is an additional component separately used from the shielded wire for the connection of the mating component as a connecting means, is connected to the shielded wire.

Besides, a protector enclosing the shielded wire (a conductor and a shielding means of the conductor) for protection thereof is also an additional component separately used from the shielded wire, which is another factor that increases the number of parts.

SUMMARY OF THE INVENTION

The present invention has been conceived in view of such circumstances, with an object to reduce the number of parts.

Accordingly, one aspect of the present invention provides a conductive path to be connected to an object to be connected provided with a mating terminal and a mating shielding member, including: a metallic conductor including a terminal portion which is integrally formed at an end of the metallic conductor to be connected to the mating terminal; a metallic pipe accommodating the metallic conductor; a tubular-shaped insulating means disposed between the metallic conductor and the metallic pipe; and a conducting means for conductively connecting the metallic pipe to the mating shielding member. Since the terminal portion to be connected to the mating terminal is unified with the conductor, the number of parts can be reduced compared with a case of additionally employing a terminal fitting for connection. Also, since the pipe serves as both shielding and protecting the conductor, the number of parts can be reduced compared with a case of employing a component exclusively for protection in addition to a shielding member.

According to another aspect of the invention, a housing retaining the terminal portion to be capable of being fitted with the mating fitting member. The terminal portion has a male configuration that can be connected to the mating terminal, for an object to be connected provided with a mating fitting member retaining the mating terminal that has a female configuration.

When connecting with an object to be connected, fitting the housing with a mating fitting member achieves a male to female fitting of the terminal portion to the mating terminal.

According to another aspect of the invention, the housing is provided with an elastically flexible lance to be engaged with the terminal portion, for retaining the terminal portion in the housing.

Since the elastically flexible lance facilitates the housing to retain the terminal portion, the terminal portion can be easily attached to the housing.

According to another aspect of the invention, the conducting means is a plate-shaped metallic bracket having a through hole. The metallic pipe is provided with a flange portion. The housing and the metallic pipe are respectively provided with an engaging means for retaining a condition where the housing and the metallic pipe are assembled so as to be engaged with each other. The metallic pipe is penetrating the through hole and the bracket is sandwiched between the flange portion and the housing.

The pipe and the bracket become conductive via a contact area between the flange portion and an edge portion of the through hole. Since the bracket is assembled to the pipe, connection to an object to be connected can be easily performed. For fixing the bracket to the pipe, the flange portion provided for the pipe and the housing are disposed so as to hold the bracket therebetween; therefore a connecting means, such as welding, is not required.

According to another aspect of the invention, an elastic member disposed between the housing and the bracket, so that the flange portion and the bracket are elastically butted.

Since the bracket and the flange portion are elastically butted because of the elasticity provided by the elastic member interposed between the housing and the bracket, contact reliability between the pipe and the bracket is improved, resulting in an upgraded shielding effect.

According to another aspect of the invention, the insulating means is in close contact with at least one an outer circumferential surface of the metallic conductor and an inner circumferential surface of the metallic pipe. A filler is filled in a gap at least one between the metallic pipe and the insulating means and between the insulating means and the metallic conductor, for restricting free movement of the metallic conductor inside the metallic pipe.

In a case, for example, where the conductive path is used under a vibrating condition, the conductor can freely move inside the pipe and resultantly the insulating means may be worn or damaged from friction with the pipe or the conductor. However according to the present invention, since a filler is provided to restrain free movement of the conductor, the insulating means can be prevented from being worn or damaged.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

[First Embodiment]

Figure 1:
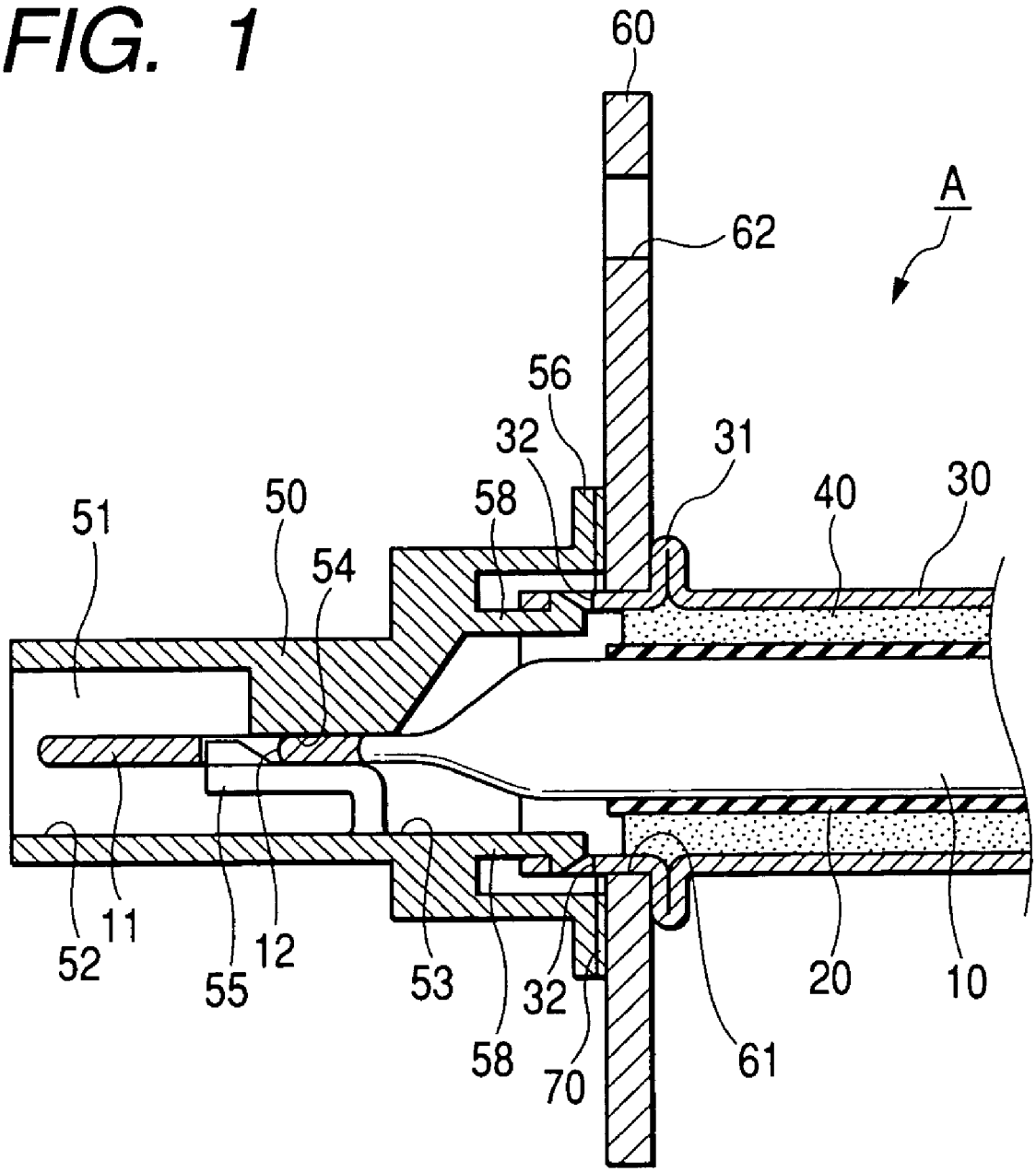
FIG. 1 is a vertical cross-sectional view showing a conductive path according to an embodiment of the present invention.
Figure 2:
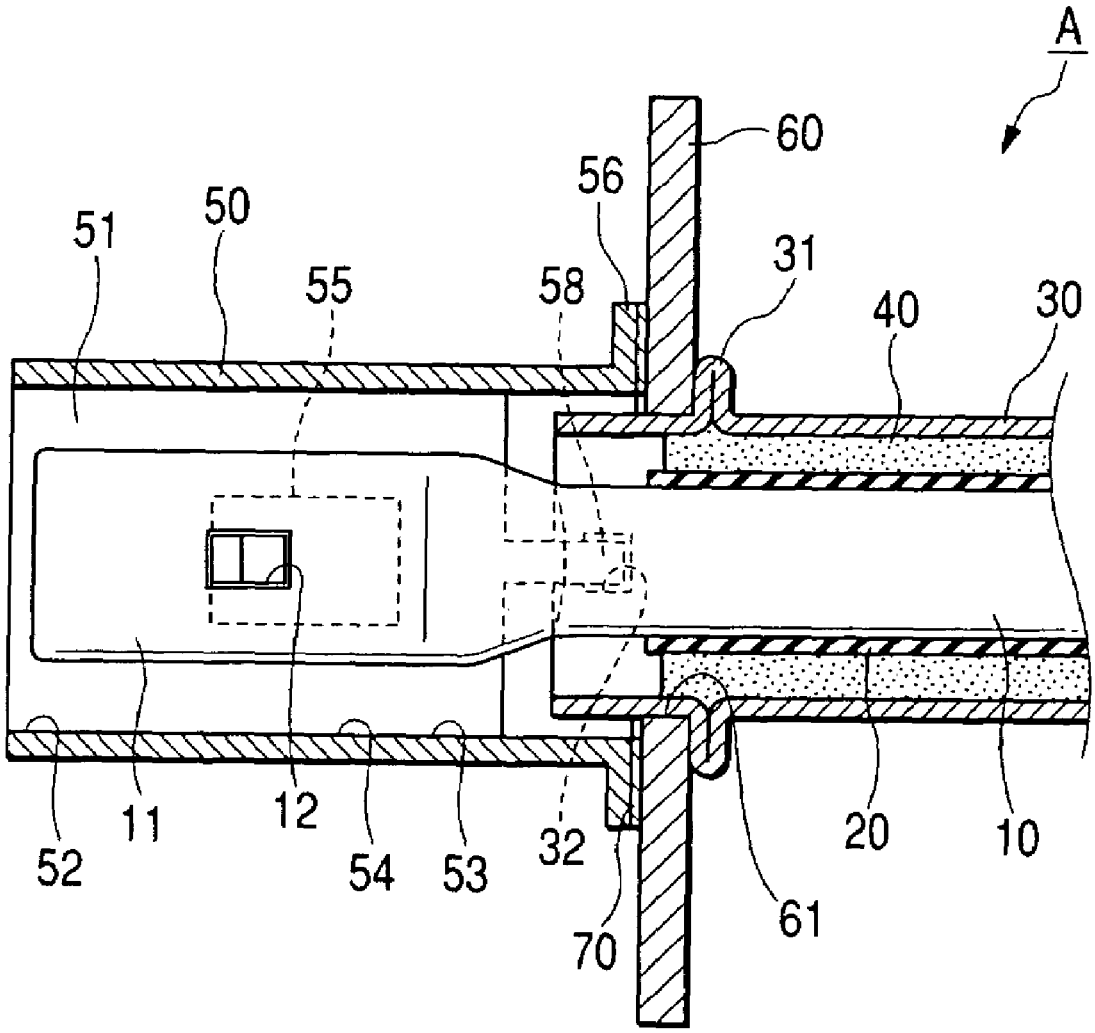
FIG. 2 is a horizontal cross-sectional view showing the conductive path.

Hereunder, a first embodiment materialized according to the present invention will be described referring to the accompanying drawings FIG. 1 through FIG. 6.

A conductive path A according to this embodiment is designed for connection to a apparatus-side connector 80 (an object to be connected) provided in an apparatus B (for example, a motor or an inverter of an electric vehicle).

The apparatus-side connector 80 is provided with an apparatus-side terminal 81 (a mating terminal), an apparatus-side housing 82 (a mating fitting member) and an apparatus-side shielding shell 83 (a mating shielding member). The apparatus-side shielding shell 83, which constitutes a part of a casing enclosing a main body (not shown) of the apparatus, includes a chamber 84 recessed inwardly (to the left in FIG. 3) from a lateral face thereof. The chamber 84 has a connection hole 85 formed in a back and forth direction through a rear wall thereof, and the apparatus-side housing 82 is fixed to the rear wall of the chamber 84 so as to penetrate the connection hole 85. The apparatus-side housing 82 is provided with a terminal retainer 82*a* extending in a back and forth direction through the connection hole 85 into the chamber 84 so as to be enclosed therein, and the terminal retainer 82*a* encloses a female type apparatus-side terminal 81. The apparatus-side terminal 81 includes a box-type connector 81*a* of a rectangular cylindrical shape formed over approximately half of the forward side of the apparatus-side terminal 81, and an elastic contact piece (not shown) is disposed inside the box-type connector 81*a*. On the remaining approximately half of the backward side of the apparatus-side terminal 81 an open barrel type crimp connector 81*b* is provided, to which a wire 86 is connected by crimping. The wire 86 is led out through the rear end face of the apparatus-side housing 82, and is connected to the main body of the apparatus inside the apparatus-side shielding shell 83.

Now, the conductive path A according to this embodiment will be described. The conductive path A is provided with a conductor 10, a pipe 30, a housing 50 and a bracket 60 (a conducting means).

The conductor 10 is made of a metal material such as a copper alloy, an aluminum alloy or the like, and is a slender bar material having a circular cross-section over an entire length thereof. A tip end portion (the left side end portion in FIG. 1) of the conductor 10 is subjected to plastic deformation to have a flat shape, so as to form a terminal portion 11 extending forward and having a constant width over an entire length thereof. A width of the terminal portion 11 is larger than an outer diameter of the conductor 10 except for the terminal portion 11, and a thickness (a vertical dimension) of the terminal portion 11 is smaller than an outer diameter of the conductor 10 except for the terminal portion 11. Such terminal portion 11 is provided with a rectangular lance hole 12 vertically penetrating therethrough.

The conductor 10 is enclosed in an insulating cylinder 20 (an insulating means) made of an insulative synthetic resin, closely contacting with the conductor 10 around an entire outer circumferential surface and over an entire length thereof, except for the terminal portion 11. The insulating cylinder 20 serves as insulation, by enclosing the conductor 10, between the pipe 30 and the conductor 10. Here, the insulating cylinder 20 may be independently formed and applied to the conductor 10, or may be unified with the conductor 10 by insert-molding. Such conductor 10 and the insulating cylinder 20 are enclosed in (inserted through) the pipe 30.

The pipe 30 is made of a metal material such as an aluminum alloy, a stainless steel or the like, and is a slender cylinder of a circular shape over an entire length thereof. The pipe 30 is provided, at a front end portion thereof, with a flange portion 31 concentrically and continuously formed around an entire circumference thereof. The flange portion 31 may be formed by hammering an entire circumferential wall of the pipe 30 outwardly, and pinching the hammered portion into close contact in a back and forth direction (i.e. a longitudinal or an axial direction of the pipe 30). Also, the pipe 30 is provided with engaging holes 32 at a front end portion thereof, beyond the flange portion 31. The engaging hole 32 is penetrating between inner and outer circumferential surfaces of the pipe 30, and may be disposed in two opposite positions which are spaced 180. and sandwich the axis of the pipe 30.

An inner diameter of the pipe 30 is made larger than an outer diameter of the conductor 10 and of the insulating cylinder 20. Accordingly, there is a gap between an outer circumferential surface of the insulating cylinder 20 and an inner circumferential surface of the pipe 30. This gap is filled with a filler 40 made of a foamed material, to eliminate a sizable gap. Filling the gap between the insulating cylinder 20 and the pipe 30 with such filler 40 restricts free movement (backlash) of the conductor 10 in a radial direction inside the pipe 30. The filler 40 also restrains free movement of the conductor 10 in an axial direction (back and forth direction) inside the pipe 30. Here, the terminal portion 11 is exposed from a front end portion of the pipe 30.

The housing 50 is made of a synthetic resin, and has a cavity 51 therein which penetrates in a back and forth direction. A front end portion of the cavity 51 includes a fitting recess 52, to be fitted with the apparatus-side housing 82. A rear end portion of the cavity 51 includes a rear chamber 53 for enclosing a round bar-shaped portion of the conductor 10 slightly behind the terminal portion 11 and a front end portion of the pipe 30. The rear chamber 53 is provided with a pair of flexible engaging pieces 58 of a cantilever configuration backwardly extending from vertically opposing positions on an inner wall of the rear chamber 53. A central portion of the cavity 51 includes a terminal retaining section 54 having a ceiling downwardly protruding with respect to the fitting recess 52 and the rear chamber 53. The terminal retaining section 54 is provided with a forwardly extending lance 55 of a cantilever configuration rising from a bottom portion of the terminal retaining section 54. Further, the housing 50 is provided with a butting portion 56 outwardly protruding from a rear end portion thereof.

Such housing 50 is to be assembled to the conductor 10 and the pipe 30 from a forward direction. When the assembly is completed, a rear portion of the terminal portion 11 is enclosed in the terminal retaining section 54, to be retained under a restriction to a back and forth movement by the engagement of the lance 55 and the lance hole 12. Also, a tip end portion of the terminal portion 11 is exposed in the fitting recess 52, to be subsequently connected to the apparatus-side terminal 81. Further, the engaging hole 32 of the pipe 30 is engaged with the flexible engaging piece 58, by which the housing 50 is prevented from breaking apart from the pipe 30 in a forward direction. In addition, though a rear face of the butting portion 56 of the housing 50 is forwardly positioned from a front face of the flange portion 31 of the pipe 30, the bracket 60 and an elastic member 70 are interposed between the butting portion 56 and the flange portion 31.

The bracket 60 is made of a plate-shaped metal, and orthogonally disposed with respect to the axis of the pipe 30. The bracket 60 is provided with a circular through hole 61 formed in a back and forth direction, which has an inner diameter equal to or slightly larger than an outer diameter of the pipe 30. The bracket 60 also has a bolt hole 62 penetrating in a back and forth direction at an upper end portion thereof. Such a bracket 60 is attached to the pipe 30 from a forward direction prior to assembling the housing 50 to the pipe 30 by fitting the through hole 61 around a front end portion of the pipe 30, by which an edge portion of the through hole 61 of the bracket 60 is to be sandwiched between the butting portion 56 and the flange portion 31.

Also, a ring-shaped elastic member 70 constituted of a spring washer is interposed between the bracket 60 and the butting portion 56. The elastic member 70 can be elastically flexed so as to be axially flattened; therefore when such an elastic member 70 is sandwiched between the butting portion 56 and the bracket 60, the edge portion of the through hole 61 of the bracket 60 is pressed against the flange portion 31 because of a restoring force of the elastic member 70, resulting in a reliable contact of the bracket 60 and the flange portion 31.

Now referring to manufacturing of the conductive path A, first the insulating cylinder 20 is closely adhered on an outer circumferential surface of the conductor 10, and the conductor 10 and the insulating cylinder 20 are enclosed in the pipe 30. At this stage, since both the conductor 10 and the pipe 30 are of a rectilinear form, it is easy to handle the conductor 10. Then the conductor 10 and the pipe 30 are simultaneously bent (i.e. with the conductor 10 enclosed inside the pipe 30) in compliance with a predetermined wiring route. Thereafter, the filler 40 is injected into a gap between an outer circumferential surface of the insulating cylinder 20 and an inner circumferential surface of the pipe 30, to fill such a gap. Meanwhile, the gap may be filled with the filler 40 prior to the bending process of the conductor 10 and the pipe 30. The bracket 60 and the elastic member 70 are then attached to a front end portion of the pipe 30, and finally the housing 50 is assembled to the conductor 10 and the pipe 30 from a forward direction.

Figure 3:
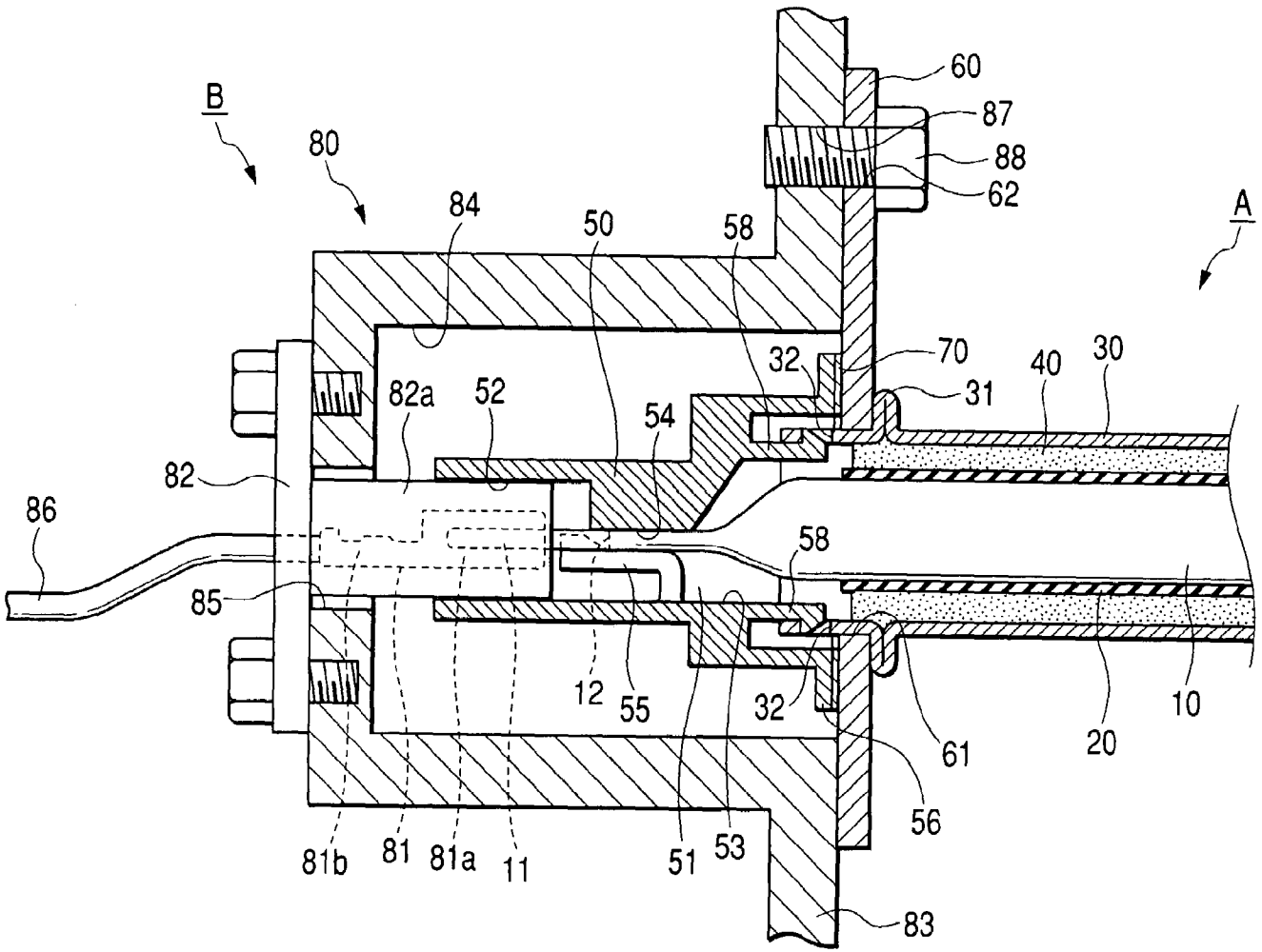
FIG. 3 is a vertical cross-sectional view showing the conductive path connected to an object to be connected.
Figure 4:
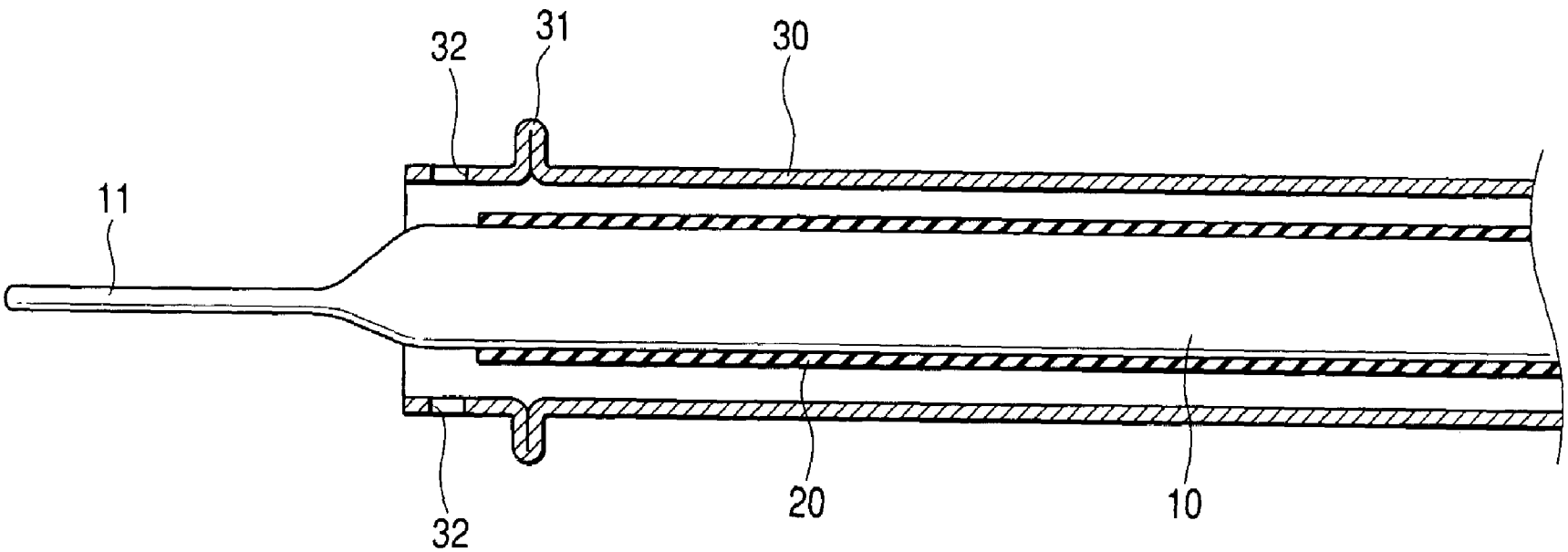
FIG. 4 is a vertical cross-sectional view showing a conductor enclosed in a pipe.
Figure 5:
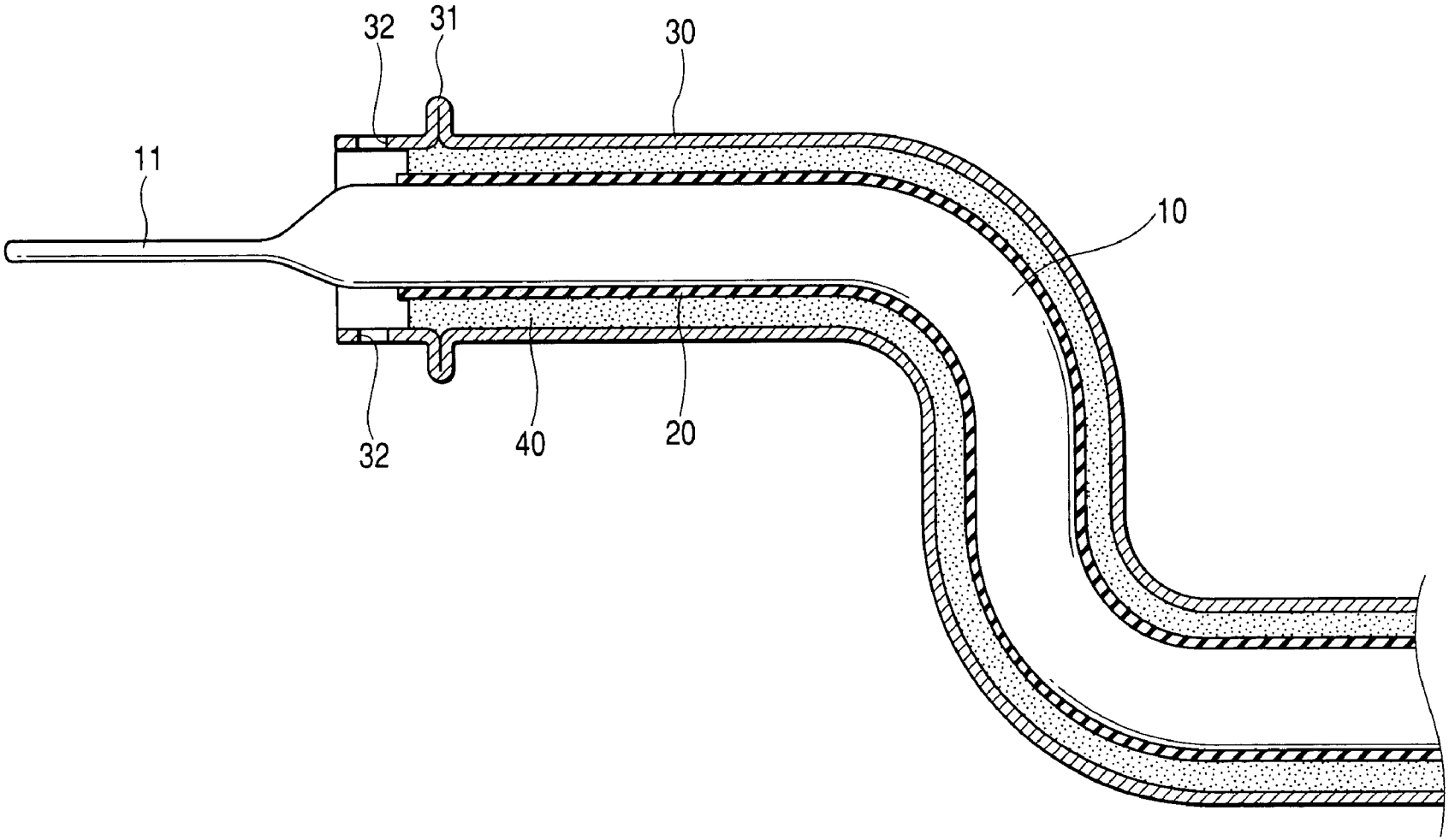
FIG. 5 is a vertical cross-sectional view showing the conductor and pipe provided with a filler and is bent.
Figure 6:
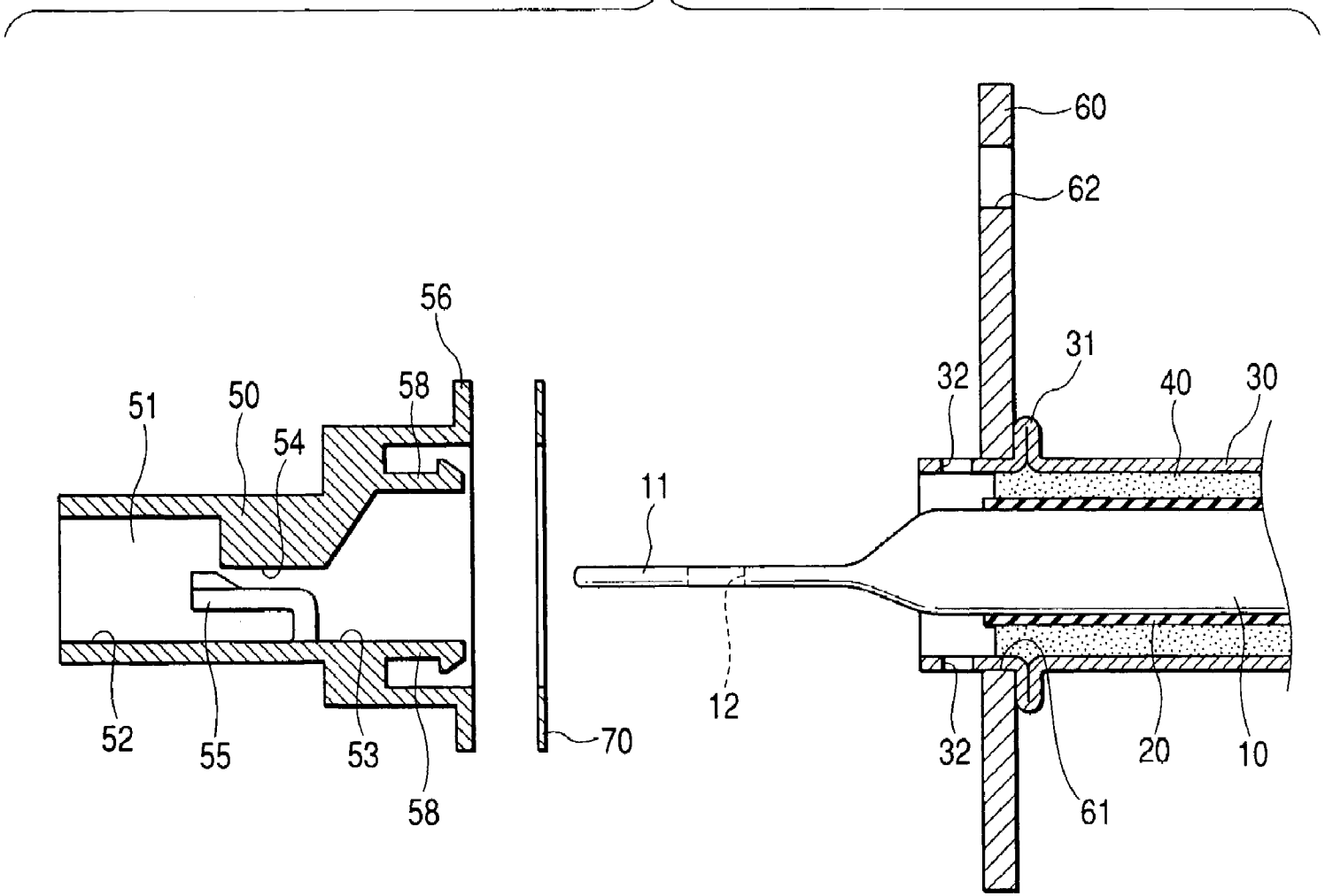
FIG. 6 is a vertical cross-sectional view showing a state in which a bracket is temporarily attached to the pipe.

The conductive path A thus manufactured is fitted with the apparatus-side connector 80 with a front side thereof oriented toward the apparatus-side connector 80 (from the right side in FIG. 3 and outside the apparatus-side shielding shell 83). At this stage, the housing 50 is inserted into the chamber 84 of the apparatus-side shielding shell 83, and the fitting recess 52 of the housing 50 is fitted with the terminal retainer 82*a* of the apparatus-side housing 82. As a result, the terminal portion 11 and the apparatus-side terminal 81 mutually achieve a male to female fitting in such a manner that the terminal portion 11 elastically contacts with the elastic contact piece of the apparatus-side terminal 81, to thereby accomplish the conductive connection of the conductor 10 and the apparatus-side terminal 81. Also, once the housing 50 is correctly fitted with the apparatus-side housing 82, the bracket 60 is butted to an outer wall face of the apparatus-side shielding shell 83 to thereby cover a remaining opening of the chamber 84, and the bolt hole 62 of the bracket 60 aligns with a female-threaded hole 87 on the apparatus-side shielding shell 83. Then, upon locating a bolt 88 through the bolt hole 62 and securely screwing it through the female-threaded hole 87, the pipe 30 becomes conductively fixed to the apparatus-side shielding shell 83 via the bracket 60, under restriction on free movement. Also, since the pipe 30 is immovably fixed with respect to the apparatus-side shielding shell 83, the housing 50 is likewise fixed with respect thereto.

According to this embodiment thus far described, since the terminal portion 11, which is the connecting means to the apparatus-side terminal 81, is integrally formed with the conductor 10, the number of parts can be reduced compared with a case of employing a separate terminal fitting.

Also, since the pipe 30 serves as both shielding and protecting the conductor 10, the number of parts can be reduced compared with a case of employing a component exclusively for protection in addition to a shielding member.

When connecting with the apparatus-side connector 80, fitting the housing 50 with the apparatus-side housing 82 achieves a male to female fitting between the terminal portion 11 and the apparatus-side terminal 81 retained by the apparatus-side housing 82; therefore work efficiency is significantly improved compared with connecting the terminals with a bolt.

Also, since the housing 50 is provided with the elastically flexible lance 55 so that the lance 55 becomes engaged with the terminal portion 11 for the housing 50 to retain the terminal portion 11, the terminal portion 11 can be easily attached to the housing 50.

Also, the bracket 60 is employed for conductively connecting the pipe 30 and the apparatus-side shielding shell 83 and such a bracket 60 is joined with the pipe 30; therefore connection of the pipe 30 with the apparatus-side shielding shell 83 can be performed by a single action, which improves work efficiency.

Further, for fixing the bracket 60 to the pipe 30, the flange portion 31 formed on the pipe 30 and the butting portion 56 of the housing 50 are disposed so as to hold the bracket therebetween; therefore an independent fixing step, such as welding, is not required.

Further, since the bracket 60 and the flange portion 31 are elastically butted because of the elasticity provided by the elastic member 70 interposed between the housing 50 and the bracket 60, contact reliability between the pipe 30 and the bracket 60 is improved, resulting in an upgraded shielding effect.

Furthermore, in a case where a gap remains between an outer circumferential surface of the insulating cylinder 20 adhered on an outer circumferential surface of the conductor 10 and an inner circumferential surface of the pipe 30, when the conductive path A is used under a vibrating condition, the conductor 10 can freely move inside the pipe 30 and resultantly the insulating cylinder 20 may be worn or damaged from friction with the pipe 30. However according to this embodiment, since the filler 40 is provided to restrain free movement of the conductor 10, the insulating cylinder 20 can be securely prevented from being worn or damaged.

The present invention is not limited to the embodiment described above with reference to the drawings, but the following embodiments are also within the technical scope of the present invention, and further thereto various modifications may be made without departing from the spirit and scope of the present invention.

1. While according to the foregoing embodiment the elastic member is provided as an independent component, the elastic member may be integrally formed with the housing or the bracket.

2. While the insulating means (insulating cylinder) is adhered on an outer circumferential surface of the conductor in the above embodiment, the insulating means may be adhered on an inner circumferential surface of the pipe. In this case, the filler can be provided between the insulating means and the conductor.

3. While the insulating means (insulating cylinder) is adhered on an outer circumferential surface of the conductor to constitute a unified component in the above embodiment, the insulating means may be provided at a spaced location from either of the pipe and the conductor. In this case, the filler can be provided in both gaps between the insulating means and the conductor and between the insulating means and the pipe.

4. While the filler is provided inside the pipe in the above embodiment, the filler is not imperatively necessary in a case where there is no likelihood that the conductor freely moves.

5. While the housing is provided for enclosing the terminal portion therein in the above embodiment, the terminal portion may remain exposed instead of being enclosed in the housing.

6. While the terminal portion and the mating terminal are connected via a male to female fitting in the above embodiment, the terminal portion may be connected by a bolt.

7. While the object to be connected is the apparatus-side connector in the above embodiment, the conductive path may be connected to another conductive path similar to the present invention, without limitation to an apparatus-side connector.

8. While the conducting means (bracket) is placed into contact with the flange portion for attaching to the pipe, the conducting means may be attached to the pipe by welding.

9. While a single conductor is enclosed in a pipe in the above embodiment, a plurality of conductors may be enclosed in a single pipe.

10. While the housing is separately formed to be assembled with the terminal portion in the above embodiment, the housing and the terminal portion may be integrally formed by insert-molding.

11. The pipe may be provided with a moisture discharging hole in the above embodiment.

12. While the conductor is a bar material having a circular cross-section in the above embodiment, a bar material having a rectangular cross-section or a bus bar of a slender plate shape may be employed as the conductor.

13. While the pipe is a cylindrical material having a circular cross-section in the above embodiment, the pipe may have a square or rectangular, oval or ellipsoidal cross-section.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A conductive path to be connected to an object to be connected provided with a mating terminal and a mating shielding member, comprising:

a metallic conductor including a terminal portion at an end of the metallic conductor to be connected to the mating terminal;

a metallic pipe accommodating the metallic conductor;

a tubular-shaped insulator disposed between the metallic conductor and the metallic pipe; and a conductor that conductively connects the metallic pipe to the mating shielding member; wherein the insulator means is in close contact with (i) an outer circumferential surface of the metallic conductor and/or (ii) an inner circumferential surface of the metallic pipe, and a filler is filled in a gap (i) between the metallic pipe and the insulator and/or (ii) between the insulator and the metallic conductor, for restricting free movement of the metallic conductor inside the metallic pipe.

2. The conductive path according to claim 1, wherein a housing, the terminal portion is capable of being fitted with a mating fitting member, and the terminal portion has a male configuration that can be connected to the mating terminal, for an object to be connected provided with the mating fitting member retaining the mating terminal that has a female configuration.

3. The conductive path according to claim 2, wherein the housing is provided with an elastically flexible lance to be engaged with a locking device of the terminal portion, for retaining the terminal portion in the housing.

4. The conductive path according to claim 2, wherein the conductor that connects the metallic pipe to the mating shield member is a plate-shaped metallic bracket having a through hole, the metallic pipe is provided with a flange portion, the housing and the metallic pipe are respectively provided with engaging devices that retain a condition where the housing and the metallic pipe are assembled so as to be engaged with each other, and the metallic pipe is penetrating the through hole and the bracket is sandwiched between the flange portion and the housing.

5. The conductive path according to claim 4, further comprising:

an elastic member disposed between the housing and the bracket, so that the flange portion and the bracket are elastically butted.

6. The conductive path according to claim 1, wherein the terminal portion is integrally formed at the end of the metallic conductor.

7. A conductive path to be connected to an object to be connected provided with a mating terminal and a mating shielding member, comprising:

a metallic conductor including a terminal portion at an end of the metallic conductor to be connected to the mating terminal;

a metallic pipe accommodating the metallic conductor;

a tubular-shaped insulator disposed between the metallic conductor and the metallic pipe; and a conductor that conductively connects the metallic pipe to the mating shielding member; wherein a housing retaining the terminal portion is capable of being fitted with a mating fitting member, the terminal portion has a male configuration that can be connected to the mating terminal, for an object to be connected provided with the mating fitting member retaining the mating terminal that has a female configuration;

the conductor that connects the metallic pipe to the mating shield member is a plate-shaped metallic bracket having a through hole, the metallic pipe is provided with a flange portion, the housing and the metallic pipe are respectively provided with an engaging device that retains a condition where the housing and the metallic pipe are assembled so as to be engaged with each other, and the metallic pipe is penetrating the through hole and the bracket is sandwiched between the flange portion and the housing.

8. The conductive path according to claim 7, wherein the housing is provided with an elastically flexible lance to be engaged with the terminal portion, for retaining the terminal portion in the housing.

9. The conductive path according to claim 7, further comprising:

an elastic member disposed between the housing and the bracket, so that the flange portion and the bracket are elastically butted.

10. The conductive path according to claim 7, wherein the terminal portion is integrally formed at the end of the metallic conductor.

11. A conductive path to be connected to an object to be connected provided with a mating terminal and a mating shielding member, comprising:

a metallic conductor including a terminal portion at an end of the metallic conductor to be connected to the mating terminal;

a metallic pipe accommodating the metallic conductor;

a tubular-shaped insulating means disposed between the metallic conductor and the metallic pipe; and a conducting means for conductively connecting the metallic pipe to the mating shielding member;

wherein a housing retaining the terminal portion to be capable of being fitted with a mating fitting member, the terminal portion has a male configuration that can be connected to the mating terminal, for an object to be connected provided with the mating fitting member retaining the mating terminal that has a female configuration;

wherein the housing is provided with an elastically flexible lance to be engaged with a locking device of the terminal portion, for retaining the terminal portion in the housing.

12. The conductive path according to claim 11, wherein the terminal portion is integrally formed at the end of the metallic conductor.

* * * * *